US010619475B2

(12) United States Patent
Gooneratne et al.

(10) Patent No.: US 10,619,475 B2
(45) **Date of Patent: *Apr. 14, 2020**

(54) SYSTEMS AND METHODS FOR WIRELESSLY MONITORING WELL CONDITIONS

(71) Applicant: Saudi Arabian Oil Company, Dhahran (SA)

(72) Inventors: Chinthaka Pasan Gooneratne, Dhahran (SA); Bodong Li, Dhahran (SA); Shaohua Zhou, Cradoc (AU)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/540,187

(22) Filed: Aug. 14, 2019

(65) Prior Publication Data

US 2019/0368340 A1 Dec. 5, 2019

Related U.S. Application Data

(63) Continuation of application No. 16/020,176, filed on Jun. 27, 2018, now Pat. No. 10,436,022, which is a (Continued)

(51) Int. Cl.
*E21B 47/12* (2012.01)
*G08C 17/02* (2006.01)
(Continued)

(52) U.S. Cl.
CPC ..... *E21B 47/12* (2013.01); *E21B 41/0085* (2013.01); *E21B 47/00* (2013.01); *E21B 47/122* (2013.01); *G08C 17/02* (2013.01)

(58) Field of Classification Search
CPC ..... E21B 47/00; E21B 47/12; E21B 41/0085; G08C 17/02
(Continued)

(56) References Cited

U.S. PATENT DOCUMENTS 4,597,067 A * 6/1986 Bockhorst ..... E21B 47/16 175/40
6,218,959 B1 4/2001 Smith
(Continued)

FOREIGN PATENT DOCUMENTS

WO WO2004113677 A1 12/2004
WO WO2014176937 A1 11/2014
WO WO2014190773 A1 12/2014

OTHER PUBLICATIONS

International Search Report and Written Opinion for International Application No. PCT/US2018/022089 (SA5621); International Filing Date Mar. 13, 2018; Report dated Jun. 8, 2018; (pp. 1-13).

*Primary Examiner* — Omar Casillashernandez
(74) *Attorney, Agent, or Firm* — Bracewell LLP; Constance G. Rhebergen; Vivek P. Shankam

(57) ABSTRACT

A system for wirelessly monitoring well conditions includes a set of wireless transceivers placed along a drill string inside a well, each transceiver placed within at least half the maximum distance that each transceiver can transmit data, and a power generator attached to each transceiver that powers the respective transceiver, the power generator including a first material that is of one polarity and a second material that is fixed in position and is of opposite polarity of the first material, wherein the first material is propelled toward the second material based on the motion of the power generator so that the two materials have a maximized point of contact to generate maximum power. The wireless transceivers may communicate using any wireless communication technology, including but not limited to Wi-Fi, Wi-Fi Direct, and BLE.

18 Claims, 10 Drawing Sheets

Related U.S. Application Data continuation of application No. 15/903,338, filed on Feb. 23, 2018, now Pat. No. 10,156,136, which is a continuation of application No. 15/457,069, filed on Mar. 13, 2017, now Pat. No. 10,072,495.

(51) Int. Cl.
*E21B 47/00* (2012.01)
*E21B 41/00* (2006.01)

(58) Field of Classification Search
USPC ..... 340/854.6
See application file for complete search history.

(56) References Cited

U.S. PATENT DOCUMENTS 6,241,028 B1 * 6/2001 Bijleveld ..... E21B 23/00 175/40
7,450,053 B2 * 11/2008 Funk ..... E21B 29/06 324/323
7,862,228 B2 * 1/2011 Popilian ..... G01K 1/12 374/136
8,115,651 B2 2/2012 Camwell et al.
8,179,278 B2 5/2012 Shakra et al.
9,013,144 B2 * 4/2015 Cooley ..... H01G 11/58 320/112
9,091,145 B2 7/2015 Colvin et al.
9,181,797 B2 * 11/2015 Zientarski ..... H04B 13/02
9,284,834 B2 3/2016 Alteirac et al.
9,453,410 B2 9/2016 Logan et al.
9,458,711 B2 10/2016 Zelm
2006/0016606 A1 * 1/2006 Tubel ..... E21B 41/0085 166/386
2009/0045974 A1 2/2009 Patel
2009/0080291 A1 3/2009 Tubel et al.
2010/0133006 A1 * 6/2010 Shakra ..... E21B 41/0085 175/24
2013/0106615 A1 5/2013 Prammer
2014/0292138 A1 * 10/2014 Wang ..... H02N 1/04 310/300
2014/0300248 A1 * 10/2014 Wang ..... G01L 9/0072 310/300
2014/0338458 A1 * 11/2014 Wang ..... G01L 1/005 73/658
2016/0194952 A1 7/2016 Switzer et al.
2017/0346416 A1 * 11/2017 Rutgers ..... H02N 1/04

* cited by examiner

SYSTEMS AND METHODS FOR WIRELESSLY MONITORING WELL CONDITIONS

BACKGROUND

1. Field

Embodiments of the present disclosure relate to systems and methods for wirelessly monitoring well conditions using a power generator that generates power based on friction, generated by fluid or mud flow, between two materials of opposite polarity.

2. Description of Related Art

Background

Surveying and logging tools used in downhole environments consist of a Measurement While Drilling (MWD) tool and several Logging While Drilling (LWD) tools. The basic MWD tool measures wellbore parameters such as tool face orientation, inclination, azimuth, as well as environmental data such as internal temperature, tool vibration. Some dedicated near bit tools provide measurements of additional drilling parameters such as weight on bit (WOB), bit torque, etc. Typical LWD tools measure formation parameters such as gamma ray, neutron density/porosity, resistivity and nuclear magnetic resonance. The LWD tools come in combo packages, where the drilling engineer has the option of choosing the LWD tools required for a given well section.

The data from LWD and MWD sensors are transmitted to the surface using a technique called mud pulse telemetry. Mud pulse telemetry utilizes changes in mud flow pressure or pressure waves to transmit data from the tool to the surface. The three main mud pulse telemetry methods are positive, negative and continuous pulse systems. In positive pulse telemetry, the flow of mud is blocked and unblocked for short times with a valve so that the pressure inside the drill string increases and then returns to its original state, respectively. In negative pulse telemetry a dump valve is opened to divert mud from inside the drill string to the annulus resulting in the reduction of pressure in the drill string. When the valve is closed the pressure returns to its original state. In a continuous pulse system a stator and a rotor system, which can be shifted against each other, restricts the mud flow in way to produce continuous positive pressure pulses.

Typically accurate survey data is acquired during a static condition when making a pipe connection and mud pulse telemetry is activated by a pre-programmed mechanism such as mud flow or mud pressure increase within the tool. The mud pulse system then sends corresponding pressure pulses to the surface. These pressure pulses are converted to comprehensible data by pressure transducers and signal processing. This process is an example of 'uplink' communication. While mud pulse telemetry is the most widely used and reliable method of downhole communication, data communication through mud is slow and mud pulse can only reach speeds up to 20 bits per second. It should be noted that mud pulse telemetry does not work well when pressure waves are attenuated significantly due to multiphase fluids in the drillstring.

There are also other methods that can be used such as running wire cables along the drill string, which is faster than mud pulse telemetry. However, this is an expensive procedure and is not feasible due to reliability issues.

Running a large number of wires with many electrical connectors through a drill string in a liquid environment gives rise to many reliability issues that can only be resolved by pulling the drill string out of the hole. Electromagnetic waves are another method to transfer data from downhole to the surface but they experience significant attenuation and decay in downhole formations and liquids. Therefore, the frequencies used are very low resulting in a data rate similar to mud pulse telemetry. Similarly acoustic waves can be used to transmit data but the noise generated in a drilling environment has a significant influence on the sensitivity resulting in a low signal-to-noise ratio.

In onshore wells the MWD/LWD tools are typically used in directional drilling but in offshore wells generally only MWD tools are used. The method of communication between MWD/LWD sensors downhole and the surface is an integral component of MWD/LWD systems. The current method of communication, mud pulse telemetry, is very slow, has low resolution and haven't progressed at the same rate as the MWD/LWD sensors. With the advent of new technologies that can measure downhole parameters with increased resolution and sensitivity there is a need for faster data transmission. Thus a faster data communication method than mud pulse telemetry is needed to fully utilize the higher resolution data that advanced sensors can obtain.

SUMMARY

Example embodiments disclosed relate to wireless communication technology as a data transmission method in oil and gas wells. Data transmission data rates up to a million times faster than mud pulse telemetry (bits per second to megabits per second) can be achieved by coupling wireless communication technology with transceivers placed at specific locations in the drill string, to transmit data from downhole surveying and logging tools such as measurement while drilling (MWD) and logging while drilling (LWD) tools to the surface. Increased data transmission rates provide significant advantages in a drilling environment such as the opportunity to respond immediately to well control problems and revise mud programs.

Example embodiments describe a low-energy wireless communication unit to form a downhole communications module. Example embodiments describe how these communication modules can be integrated with a downhole energy harvester, packaged for survival in a high temperature environment (>125° C.) and placed along a drill string to form a high temperature, self-powered downhole communication system (HTSP-DCS), to transmit data from the bottom of a well to the surface. Sensors can be integrated with the HTSP-DCS to form a smart drill pipe that provides real time distributed sensing data. This enables real-time well control, a critical operation in fractured zones.

One example embodiment is system for wirelessly monitoring well conditions including a string of wireless transceivers placed along a drill string inside a well, each transceiver placed within at least half the maximum distance that each transceiver can transmit data, and a power generator attached to each transceiver that powers the respective transceiver, the power generator including a first material that is of one polarity and a second material that is fixed in position and is of opposite polarity of the first material, wherein the first material is propelled toward the second material based on the motion of the power generator so that the two materials have a maximized point of contact to generate maximum power.

Another example embodiment is a method for wirelessly monitoring well conditions including connecting an array of wireless transceivers along a drill string inside a well, each transceiver placed within at least half the maximum distance that each transceiver can transmit data, connecting a power generator to each transceiver for powering the respective transceivers, the power generator including a first material that is of one polarity and a second material that is fixed in position and is of opposite polarity of the first material, and propelling the first material toward the second material based on the motion of the power generator so that the two materials have a maximized point of contact to generate maximum power.

Another example embodiment is a high temperature, self-powered, downhole communications system for wirelessly monitoring well conditions, the system including an array of wireless transceivers placed along a drill string inside a well, each transceiver placed within at least half the maximum distance that each transceiver can transmit data, and a power generator attached to each transceiver that powers the respective transceiver, wherein the wireless transceivers communicate over a wireless communication method selected from the group consisting of Wi-Fi, Wi-Fi Direct, Bluetooth, Bluetooth Low Energy, and ZigBee.

BRIEF DESCRIPTION OF DRAWINGS

The foregoing aspects, features, and advantages of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

DETAILED DESCRIPTION

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. The term "high temperature" as referred to herein refers to temperatures above 125° C. unless otherwise noted.

Figure 1:
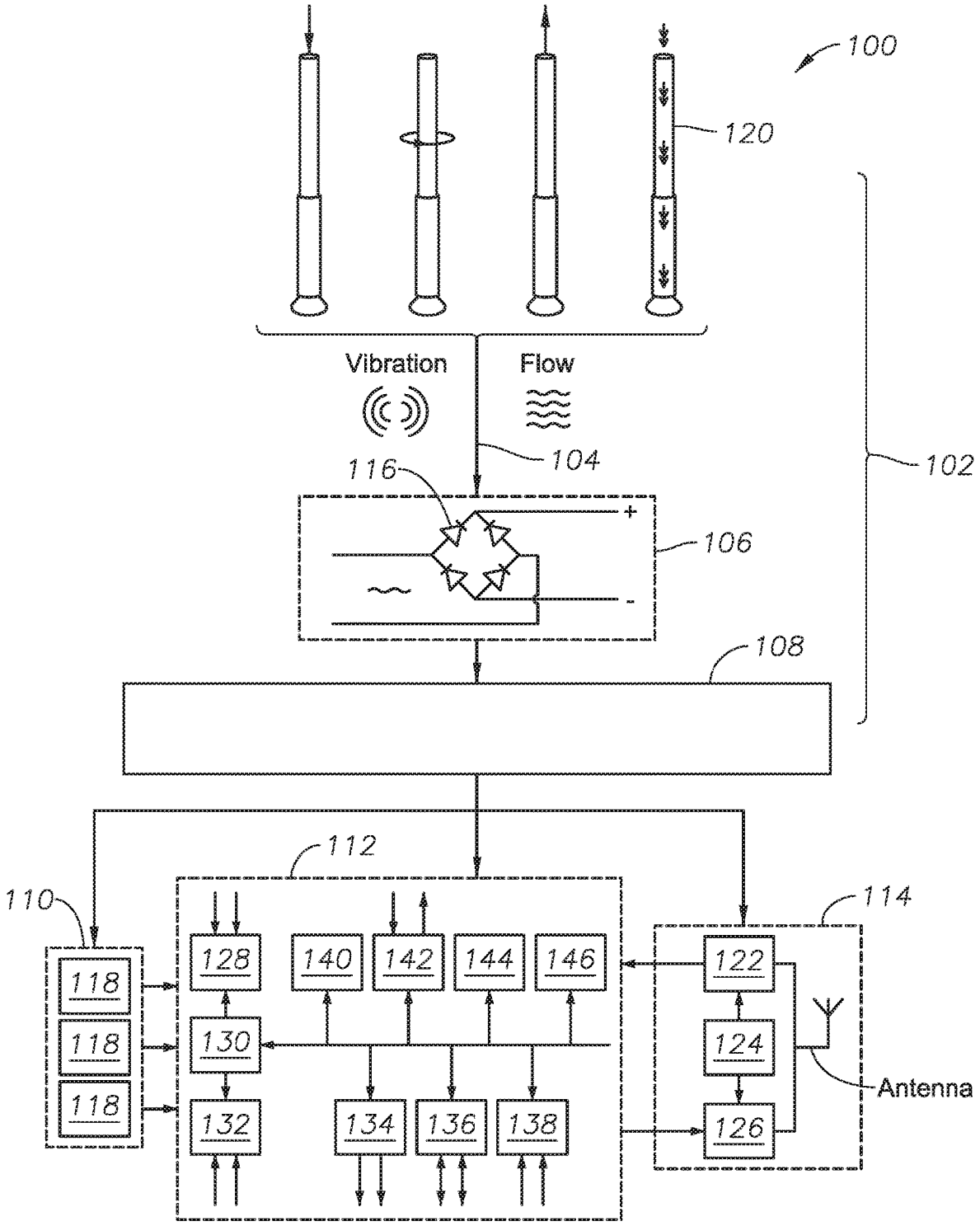
FIG. 1 is a block diagram illustrating a system for wirelessly monitoring well conditions including a high temperature downhole power generator, microcontroller, and transceiver, according to one or more example embodiments.

Turning now to the figures, FIG. 1 is a block diagram illustrating a system for wirelessly monitoring well conditions, according to one or more example embodiments. Drill strings 120 are exposed to a variety of environments such as high temperature, pressure, torque, vibration and rotation during the drilling process. The drill string 120 experiences axial, lateral and torsional vibration for example, when it is drilling a formation, when it is being pulled out of a hole, when it is being run inside a hole and during a reaming trip. As FIG. 1 shows, the energy contained in these motions can be extracted for generating electricity.

One example embodiment is a high temperature power generating device 100 including a power generator 102. The power generator 102 can generate electricity friction and can be utilized in a well to fully exploit the available downhole energy sources. Vibration can be triggered directly by mechanical motion and mud flow and in-directly with mud flow and the use of a mini-turbine, for example. Generating electricity by friction is based on the principle that an object becomes electrically charged after it contacts another material through friction. When they contact, charges move from one material to the other. Some materials have a tendency to gain electrons and some to lose electrons. If material A has a higher polarity than material B, then electrons are injected from material B into material A. This results in oppositely charged surfaces. When these two materials are separated there is a current flow, when a load is connected between the materials, due to the imbalance in charges between the two materials. The current flow continues until both the materials are at the same potential. When the materials move towards each other again there will be a current flow but in the opposite direction. Therefore, this contact and separation motion of materials can be used to generate electricity. The surfaces can be modified to increase the friction between materials and to increase the surface charge density by fabricating structures such as nano-pillars, patterning and depositing nanoparticles.

The generated electrical energy first has to be changed from an alternating current to a direct current. This can be achieved by a bridge rectifier circuit 106 employing diodes 116 as shown in FIG. 1. The bridge rectifier may be connected to material A or material B using one or more electrodes 104. The downhole power generator 102 continues generating electricity as long as the contact and separation mechanism is in motion. A more feasible way to optimize this generated electricity is to store the electrical energy so that it can be used as a regulated power source even when there is insufficient vibration or mud flow. The storage unit 108 can be either a di-electric capacitor for use at high temperatures, a ceramic, an electrolytic or a super capacitor. By storing the energy in a capacitor, power can be provided continuously to the sensors, instrumentation and communication devices. Compared to batteries, capacitors are easier to integrate into a circuit, are generally cheaper, can be bought off the shelf and are easier to dispose. According to one example embodiment, the storage unit includes one of dielectric capacitors, ceramic film capacitors, electrolytic capacitors, supercapacitors, double-layer capacitors, or pseudo-capacitors.

The storage unit 108 provides power to the microcontroller unit 112, which performs the power management and control functions of the system 100. The microcontroller unit 112 may include one or more processors 130, which may be connected to a flash memory 140, external memory 134, interface(s) 142, EEPROM 144, RAM 146, input/output ports 136, and timers 138 using one or more buses 150. The one or more processors 130 may also be connected to an interrupt control 128, and an oscillator or accelerometer 132, such as a MEMS accelerometer, for example. The microcontroller type may be 8051, PCI, AVR or ARM, for example. The microcontroller 112 is connected to a transceiver and an antenna unit 114. The transceiver 114 employs low power wireless technologies such as low-power Wi-Fi, Wi-Fi Direct, Bluetooth, Bluetooth Low Energy (BLE), ZigBee, etc. Higher frequencies allow a better signal and a longer transmission distance. However, the system 100 must be optimized since attenuation and power requirements are also higher at higher frequencies. The antennas 114 can be directional, omni-directional and point-to-point. They can also be planar antennas such as monopole, dipole, inverted, ring, spiral, meander and patch antennas. According to one example embodiment, the transceiver and an antenna unit 114 may include a transmitter 126, a receiver 122, a clock 124, and one or more antennas, for example.

The microcontroller unit 112 may be operatively coupled to a sensor unit 110, which may include one or more sensors 118. Sensors 118 may be used for MWD or LWD purposes, and may include a variety of sensors that perform MWD and LWD functions, as known to one of skill in the art.

Figure 2:
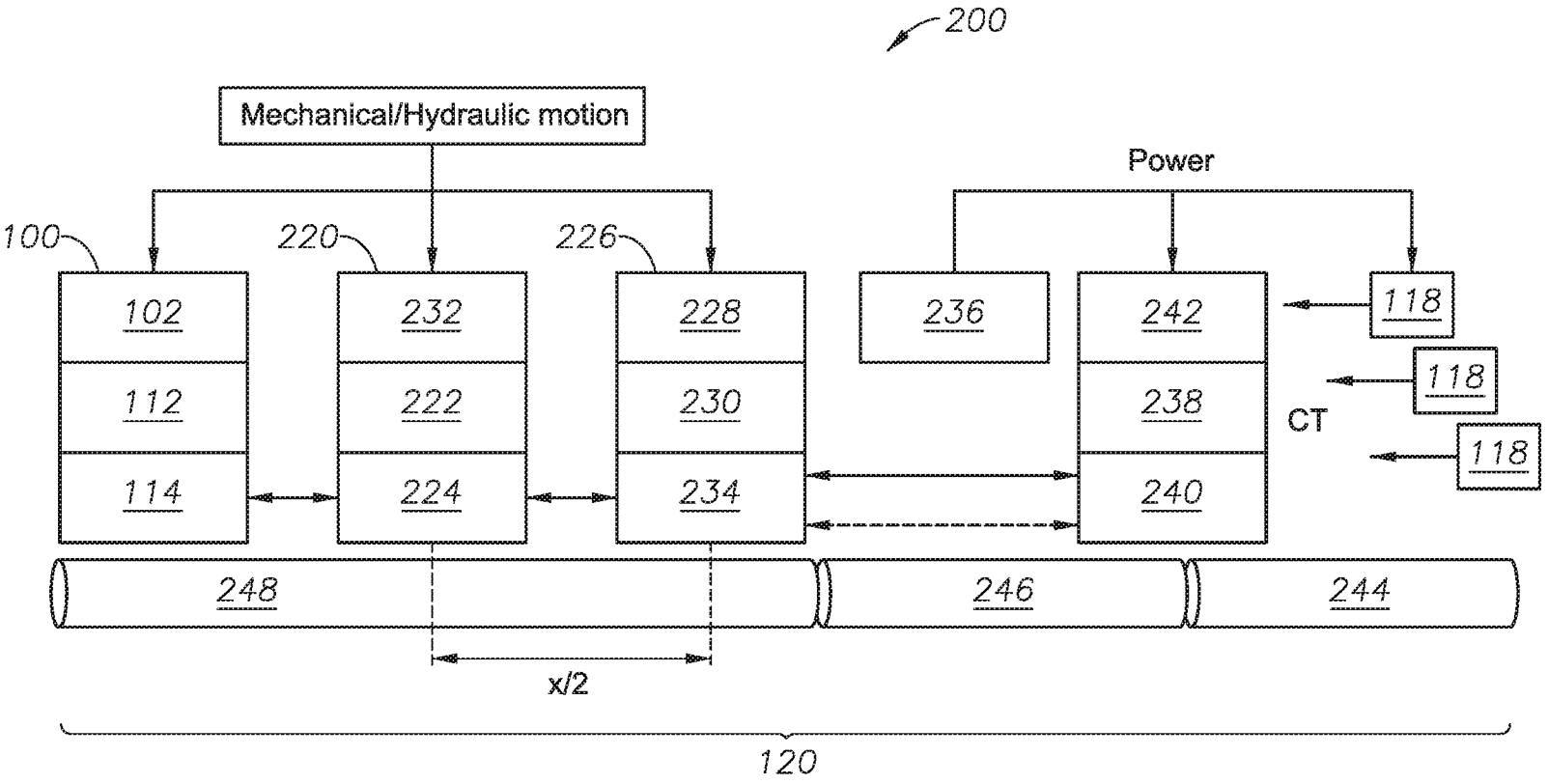
FIG. 2 is a block diagram illustrating a system for wirelessly monitoring well conditions including a plurality of high temperature downhole power generators, microcontrollers and transceivers, according to one or more example embodiments.

FIG. 2 is a block diagram illustrating a high temperature, self-powered downhole communication system 200 for wirelessly monitoring well conditions including a plurality of high temperature downhole power generating devices 100, 220, 226, including power generators 102, 232, 228, according to one or more example embodiments. Drill strings 120 are exposed to a variety of environments such as high temperature, pressure, torque, vibration and rotation during the drilling process. The drill string 120 experiences axial, lateral and torsional vibration for example, when it is drilling a formation, when it is being pulled out of a hole, when it is being run inside a hole and during a reaming trip. The energy contained in these motions can be extracted for generating electricity. The power generators 102, 232, 228 can generate electricity by using friction between two materials of opposite polarities. Mechanical/hydraulic energies usually encountered in a drilling environment, such as vibration and mud flow, are fully exploited to generate friction between the two materials. Generating electricity by friction is based on the principle that an object becomes electrically charged after it contacts another material through friction. When these two materials are separated there is current flow, when a load is connected between the materials, due to the imbalance in charges between the two materials. The generated electrical energy is converted from an alternating current to a direct current by a bridge rectifier circuit employing diodes. The generated electricity can be stored so that it can be used as a regulated power source even when there is insufficient vibration or mud flow. The storage unit can be either a regular di-electric capacitor de-rated for use at high temperatures, a ceramic, an electrolytic or a super capacitor. By storing the energy in a capacitor, power can be provided continuously to the sensors, instrumentation and communication devices. The storage unit provides power to the microprocessor/microcontroller unit, which performs the power management and control functions of the system. The microcontroller may be 8051, PCI, AVR, or ARM. The microcontroller is connected to a transceiver and an antenna.

In this system 200 the turbine/alternator and/or batteries 236 supply power to the MWD 246 and LWD 244 tools. However, the conventional mud pulse telemetry system has been replaced by an array of high temperature downhole power generating devices 100, 220, 226 placed at specific locations on the drill pipe 248, from the bottom of the well to the surface. The transceivers 114, 224, 234 employ low power wireless technologies such as low-power Wi-Fi, Wi-Fi Direct, Bluetooth, Bluetooth Low Energy, ZigBee, etc. Higher frequencies allow a better signal and a longer transmission distance. However, the system 200 must be optimized since attenuation and power requirements are also higher at higher frequencies. The antennas can be directional, omni-directional and point-to-point. They can also be planar antennas such as monopole, dipole, inverted, ring, spiral, meander and patch antennas.

Each transceiver 114, 224, 234 is connected to its own power generator 102, 232, 228, which is triggered by mechanical/hydraulic motions in a downhole drilling environment. The distance between these transceivers 114, 224, 234 are dependent on the wireless communication technologies used, the power provided by the power generators 102, 232, 228, the downhole environment and the power management circuit of the microcontroller units 112, 222, 230. The transceiver array 114, 224, 234 transmits data, from one transceiver to another as in a relay, from the bottom of the well to the surface. The data from MWD/LWD sensors 118 are stored in a central processor in the main unit 242. The central processor is connected to a transceiver, 238 and may also include a back-up transceiver 240. Data from the sensors 118 are transmitted to the central processor of the main unit 242 serially. Data from the different sensors 118 is stored in memory separated by unique headers to identify the different sensors data was obtained from.

Prior to data transfer from the transceiver in the main unit (CT) 242 to the first transceiver 234 in the array (T1), where T1 is at/near the bottom of the well and the last transceiver (TN) is at the surface or near the surface, a low data rate 'acknowledge' signal is sent from CT to T1. This switches T1 from 'sleep' mode to 'stand by' mode' and to finally 'active' mode. CT switches to 'stand by' mode since it is expecting a signal back from the first transceiver. If CT switches to 'sleep' mode instead it will take more power to switch it back to 'active' mode. Once the 'acknowledge' signal is received at T1 it sends a 'ready' signal to CT. The CT then transmits the first data stream, from sensor A for example, to T1. Once the data is transmitted, the central processor shuts down its power to the transceiver for an amount of time determined by how long it takes for the data to be relayed along the transceiver array to the surface. The central processor can wait until the data reaches the surface or until it reaches half the distance along the drill string or any other pre-determined time before it sends an acknowledge signal again to the first transceiver to transmit the next data stream, from sensor B, for example. This has to be optimized according to the downhole environment the drill string is exposed to, such as the mud type and geological formations, which can affect the data transmission rate.

Once T1 receives data from CT it stores it in memory and then sends a signal to T3, located a distance 'x' away from T1, to check if it is ready to receive data. The distance 'x' is the maximum distance a signal can be transmitted between two transceivers. If T3 is ready it sends a signal back saying it is ready as explained before. Then the first transceiver transmits data to T3. T3 then performs the same functions as T1 starting by sending a signal to T5. In the event T1 does not get a signal back from T3, T1 sends another signal again to confirm. If there is still no signal T1 sends a signal to T2, where the transmission distance is x/2; x/2 is half the maximum distance a signal can be transmitted between two transceivers. If there is a confirmation signal back from T2 then T1 transmits the data to T2. T2 then performs the same process T1 performed, transfer data to T4, in order to transfer the data up the drill string, all the way to the surface.

Another method of data transmission is for T1 to send a signal to T2, where T2 is a distance x/2 away from T1, to check if it is ready to receive data. If T2 is ready it sends a signal back saying it is ready as explained before. Then the first transceiver transmits data to T2. In the event T1 does not get a signal back from T2, T1 sends another signal again to confirm. If there is still no signal T1 sends a signal to T3, where the transmission distance is x; x is the maximum distance a signal can be transmitted between two transceivers. If there is a confirmation signal back from T3 then T1 transmits the data to T3. T3 then performs the same process T1 performed in order to transfer the data up the drill string, all the way to the surface. This way the communication link from downhole to the surface can be kept active even in the event one transceiver in the array along the drill string may cease to function. This method is based on the assumption that it is very unlikely two immediate transceivers would fail and cease to function. If the need arises to increase the number of transceivers a given transceiver can transmit to from 2 to N, then the maximum distance a signal can be transmitted between two transceivers can be divided by N; the distance between two immediate transceivers on the drill string will then be x/N.

The power to the microcontroller units 112, 222, 230 is provided by the respective power generators 102, 232, 228. The energy harvesters or power generators 102, 232, 228 are based on using downhole hydraulic/mechanical energies to drive materials to contact and separate from each other to generate electricity. The energy harvester consists of a rectifier to change an alternating current to a digital current and a capacitor to store the electrical energy. The power management is performed by a microcontroller unit, which handles the power requirements of the sensors and the communication module, where the communication module consists of a transceiver and an antenna.

Data obtained by the MWD 246 or LWD 244 might not stay constant and may change over time due to drilling and other process performed inside a wellbore. For example, temperature and pressure data measured by MWD/LWD sensors at certain depths along a wellbore may change over time. Therefore, the driller cannot obtain real-time information of these parameters at these depths unless he runs the MWD/LWD sensors at these depths again, which is very costly and not a feasible operation. An example of an advantage in having real time well data is in the real-time evaluation of kicks in wells. Drilling in deep reservoirs with partial/severe loss circulation is tremendously expensive since the driller is drilling 'blind' as there is no real-time data on where the mud is being lost to the formation. Therefore, it is impossible to know the amount and the density of mud that needs to be added into the drill string and the annular to keep drilling and ensuring that kicks don't travel to the surface.

Figure 3:
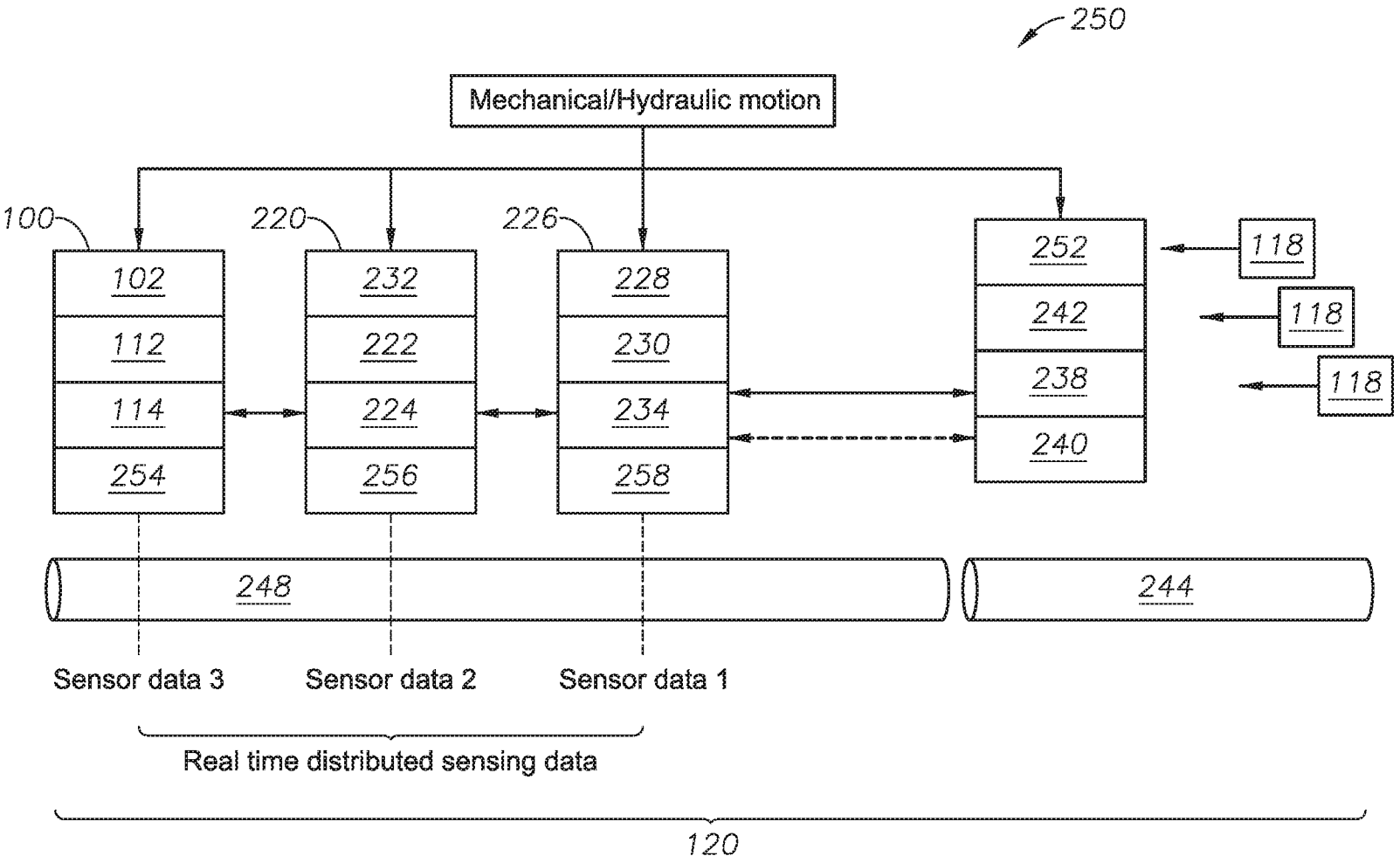
FIG. 3 is a block diagram illustrating a system for wirelessly monitoring well conditions including a plurality of high temperature downhole power generators, microcontrollers, transceivers and sensors according to one or more example embodiments.

One solution is to have a smart drill pipe 248 with one or more sensors 254, 256, 258 coupled to each transceiver 114, 224, 234 as shown in FIG. 3, for example. FIG. 3 is a block diagram illustrating a high temperature, self-powered downhole communication system 250 for wirelessly monitoring well conditions including a plurality of high temperature downhole power generating devices 100, 220, 226, according to one or more example embodiments. These sensors 254, 256, 258 can be commercially available sensors such as pressure, temperature and vibration sensors. Sensors 254, 256, 258 can be integrated with the microcontroller units 112, 222, 230 as long as electricity generated by the power generators 102, 232, 228 is sufficient to power the sensors 254, 256, 258 and the transceivers 114, 224, 234. This is achievable since the sensors and the transceivers do not operate simultaneously. Once a tool stops its operation it can shut down and go to sleep to reduce power usage and the instructions to do so are handled by the microcontroller unit. The smart drill pipe 248 gives real time distributed sensing data, which can be used to effectively monitor the well and respond immediately if there is a problem. The number and type of sensors in a communication module depend on the availability of power at each communication module. The alternator/turbine of the MWD can also be replaced with a power hub 252 that provides electrical power to downhole sensors by friction between two materials. The power hub 252 may be a single unit designed to utilize one or more of the downhole energies described before or a connection of smaller units for increased power. It will be significantly smaller than the turbine/alternator and/or battery arrangement thereby freeing up a lot of space in the drill string and can significantly reduce the cost of logging and surveying tools. It does not employ magnets and coils so there is no need for expensive non-magnetic drill collars, it doesn't depend solely on mud flow to generate electricity so doesn't need a large battery as a backup.

Figure 4:
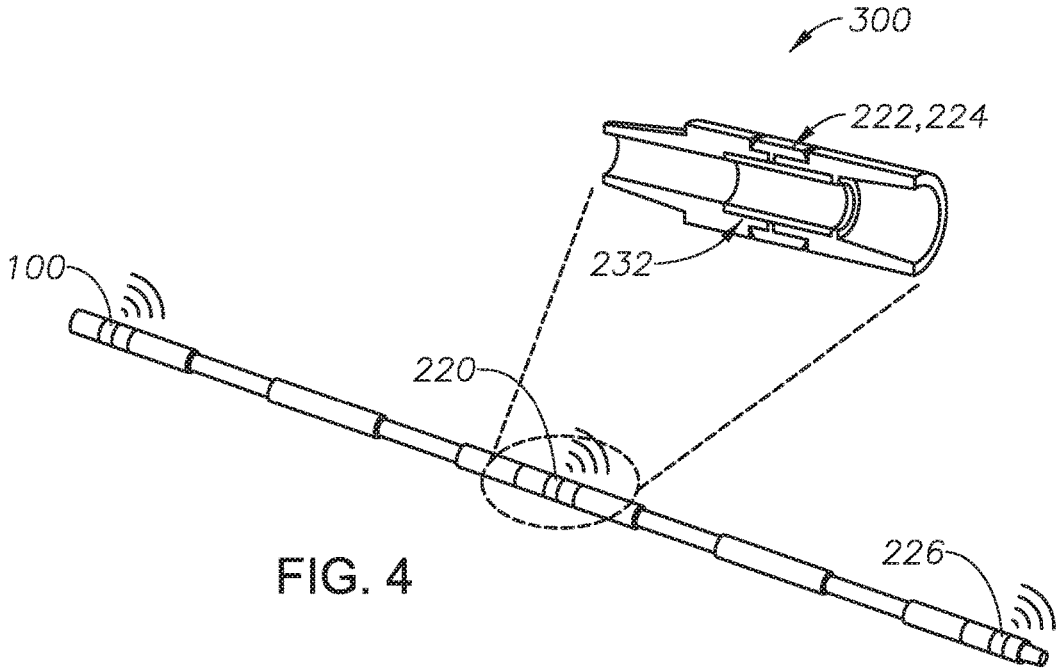
FIG. 4 is a schematic of a system for wirelessly monitoring well conditions including a plurality of high temperature downhole power generators inside a drillstring and microcontrollers and transceivers outside a drillstring, according to one or more example embodiments.
Figure 5:
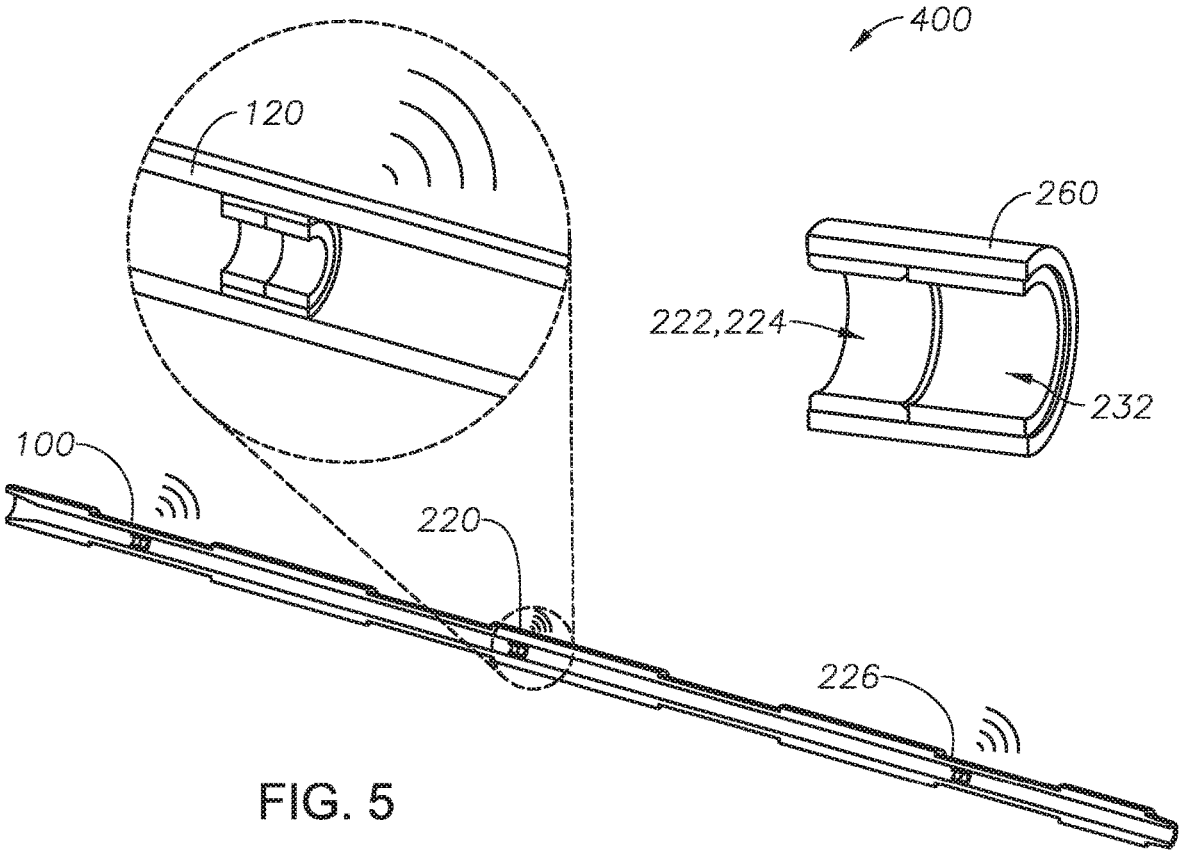
FIG. 5 is a schematic of a system for wirelessly monitoring well conditions including a plurality of high temperature downhole power generators, microcontrollers and transceivers inside a drillstring, according to one or more example embodiments.

FIGS. 4 and 5 show two methods to place the HTSP-DCS in a drill string. FIG. 4 is a schematic of a system 300 for wirelessly monitoring well conditions including a plurality of high temperature downhole power generating devices 100, 220, 226, according to one or more example embodiments. The first method, as shown in FIG. 4, involves an adapter design, where the power generator 232 is anchored to the inner wall of the drill string 120 and the microcontroller 222 and transceiver unit 224 (MTU), including an antenna, is anchored to the outer wall of the drill string 120.

FIG. 5 is a schematic of a system 400 for wirelessly monitoring well conditions including a plurality of high temperature downhole power generating devices 100, 220, 226, according to one or more example embodiments. The second method, as shown in FIG. 5, involves anchoring a band-like structure 260 to the inner wall of the drill string 120. In this case the wireless signal transmission will be inside the drill string 120 whereas in the adapter design it will be outside the drill string, along the annulus. It should be noted, however, that the shape of the adapter design in FIGS. 4 and 5 may include a hollow housing structure, which provides clearance for the drilling fluids to flow through.

Turning now to FIGS. 6-9, the example embodiments described herein provide for two main ways to capture the energy created by downhole vibrations, due to mechanical motions such as rotation of the drill string 120, and hydraulic motions such as mud flow. The designs aim to optimize the mechanical and hydraulic triggering required to optimize the generation of electricity.

Figure 6:
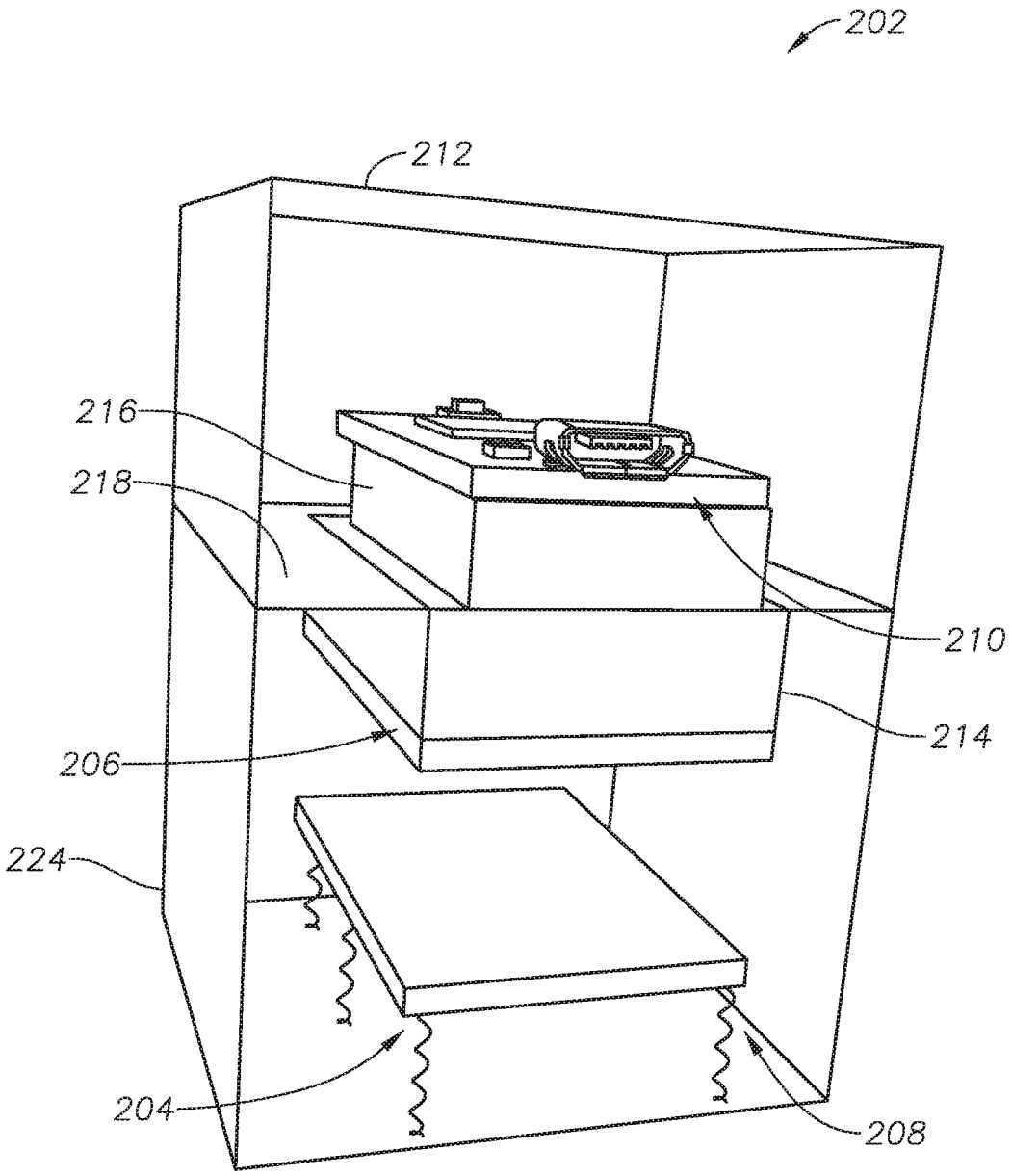
FIG. 6 is a schematic of a high temperature downhole power generating device, sensors, and transceivers, according to one or more example embodiments.
Figure 7:
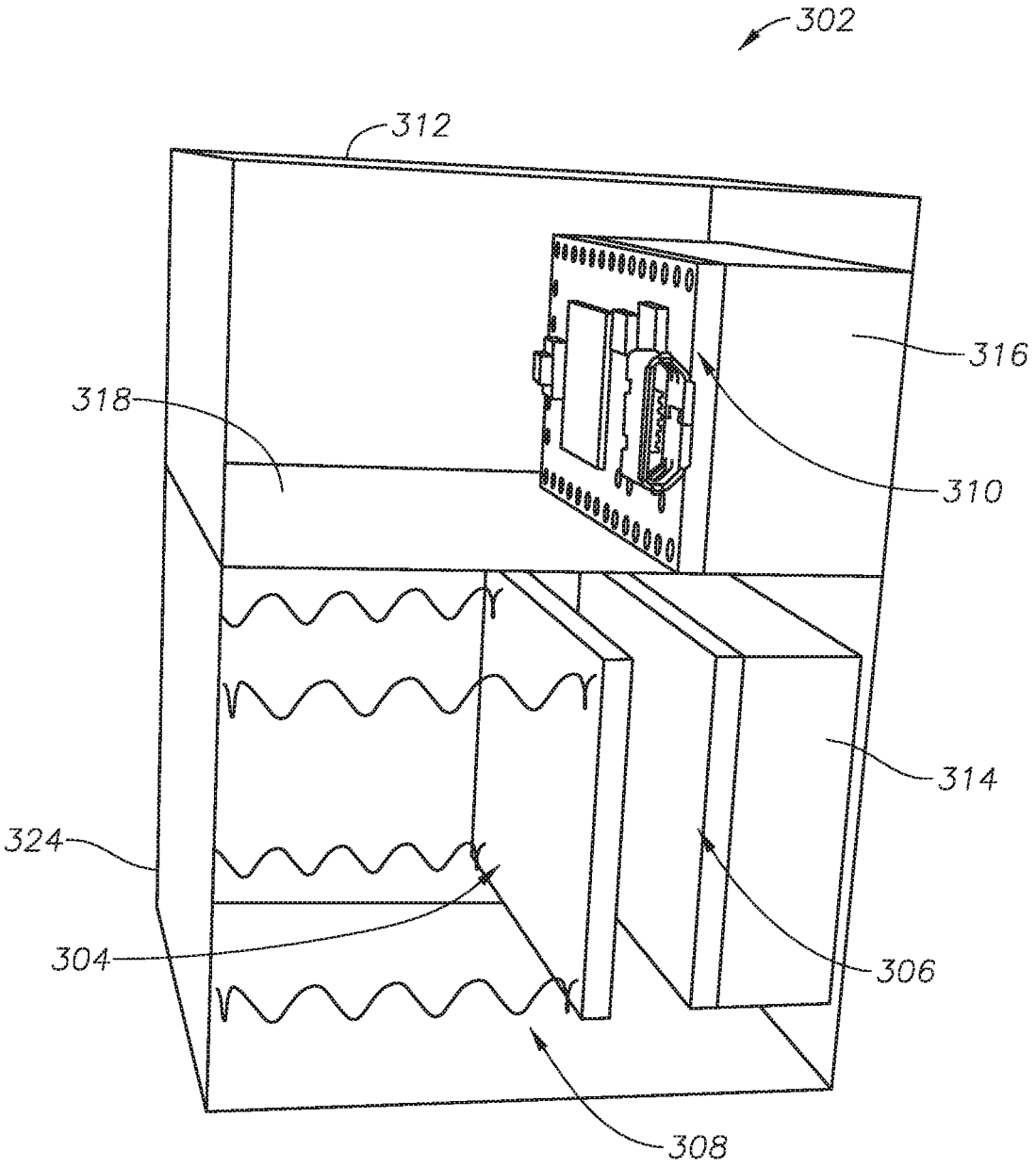
FIG. 7 is a schematic of a high temperature downhole power generating device, sensors, and transceivers, according to one or more example embodiments.

The first system 202, 302, as illustrated in FIGS. 6 and 7, for example, utilizes springs 208, 308 to propel a material 204, 304 (material A) attached to the springs 208, 308 towards another different material 206, 306 (material B), which is opposite in polarity to material A and is fixed, when there is vibration due to rotation and/or mud flow and/or noise. The stiffness of the springs 208, 308 is optimized to maximize the contact and separation motion and can be any size and shape to move and constrain material A only in the direction of material B. The springs 208, 308 are designed in such a way to minimize motion retardation and experience compression and extension at the same time. The springs 208, 308 also contribute to the momentum of material A contacting material B therefore, increasing the charge transfer between the two materials. Generally springs obey Hook's law and produce restorative forces directly proportional to their displacement. They store mechanical energy in the form of potential energy and release it as the restorative force, resulting in a constant spring coefficient. Springs 208, 308 can also be tuned to produce restorative forces that are not proportional to their displacement. These springs are not governed by Hook's law so they can be made to provide restorative forces as required by the application. The springs 208, 308 that may be used can be compression, extension, torsion, Belville springs or any other system made from elastic materials.

As illustrated in FIGS. 6 and 7, material 206, 306 is fixed on a block 214 314, on the inner drillstring interface, which insulates the connection from the power generator to the MTU 210 310. Depending on the direction of the vibration, axial and/or lateral and/or torsional, material 204, 304 contacts the fixed material 206, 306 vertically and/or slide against it and then separate. This contact and separation mechanism generates electricity as it may be apparent to one of skill in the art. There are vibrations when the drill pipe is rotated, when running in hole, pulling out of hole, drilling or reaming as well due to the noise generated from these motions. Moreover, mud flow carries kinetic energy and the magnitude of this energy is related to the speed and duration of the mud flow, which can be controlled at the surface. When the mud flow contacts the housing where the power generator is located it captures the kinetic energy from the mud and transfer this kinetic energy into vibration. The vibration of the housing triggers the motion of the springs, which moves material 204, 304, attached to them, towards the other different material, material 206, 306, which is anchored and stationary, which results in contact first and then separation. This motion may continue as long as there is vibration.

In FIG. 6 material 204 is connected by springs 208 attached to housing 224. The materials 204, 206 are rectangular in shape, but can be square, circular, triangular or any shape that maximizes the contact area, and they are positioned vertically to maximize the contact area due to lateral vibrations by contacting vertically but also to slide during axial and/or torsional vibration. In FIG. 7, materials 304, 306 are positioned horizontally to maximize the contact area due to axial vibration but also to slide during lateral and torsional vibration. In FIGS. 6-9, the microcontroller and transceiver unit (MTU) 210, 310, 410, 510 is in a special housing 212, 312, 412, 512 to minimize vibration and temperature either inside/outside the drill string 120 and therefore, is different from the housing of the power generator 224, 324, 424, 524. The housing 212, 312, 412, 512 may include a material selected from the group consisting of certain solids, transition metals, as well as high strength alloys and/or compounds of the transition metals, and high temperature dewars. According to one example embodiment, the microcontroller and transceiver unit (MTU) 210, 310, 410, 510 may be mounted on a block 216, 316, 416, 516, which may insulate the connection from the power generator portion to the MTU using a separator 218, 318, 418, 518. In order to minimize vibrations in the MTU 210, 310, 410, 510, mounts and valves can be installed to isolate vibrations, and materials such as Steel, Titanium, Silicon Carbide, Aluminum Silicon Carbide Inconel and Pyroflask, can be used to reduce the effect of high temperature. The material for housing 224, 324, 424, 524 of the power generator on the other hand should be designed to preserve its flexibility and elasticity to maximize vibrations and hence, improve the energy conversion efficiency. However, it but must be optimized so that the building blocks of the power generator will not be damaged. Therefore, for optimization we use specific materials for the building blocks of the power generator as described below. The housing 224, 324, 424, 524 can be designed from a polymer material such as elastomer, which is already used in downhole tools, or any other material that has excellent heat conduction properties and a low Young's modulus. Packaging and housing is mainly done to protect the power generator from mud and other fluids in the formation, which may degrade its performance. However, it is important that the packaging and housing does not in any way influence the energies being harvested by reducing the vibration for example. The housing 224, 324, 424, 524 and packaging should maintain or amplify the energies being harvested.

Figure 8:
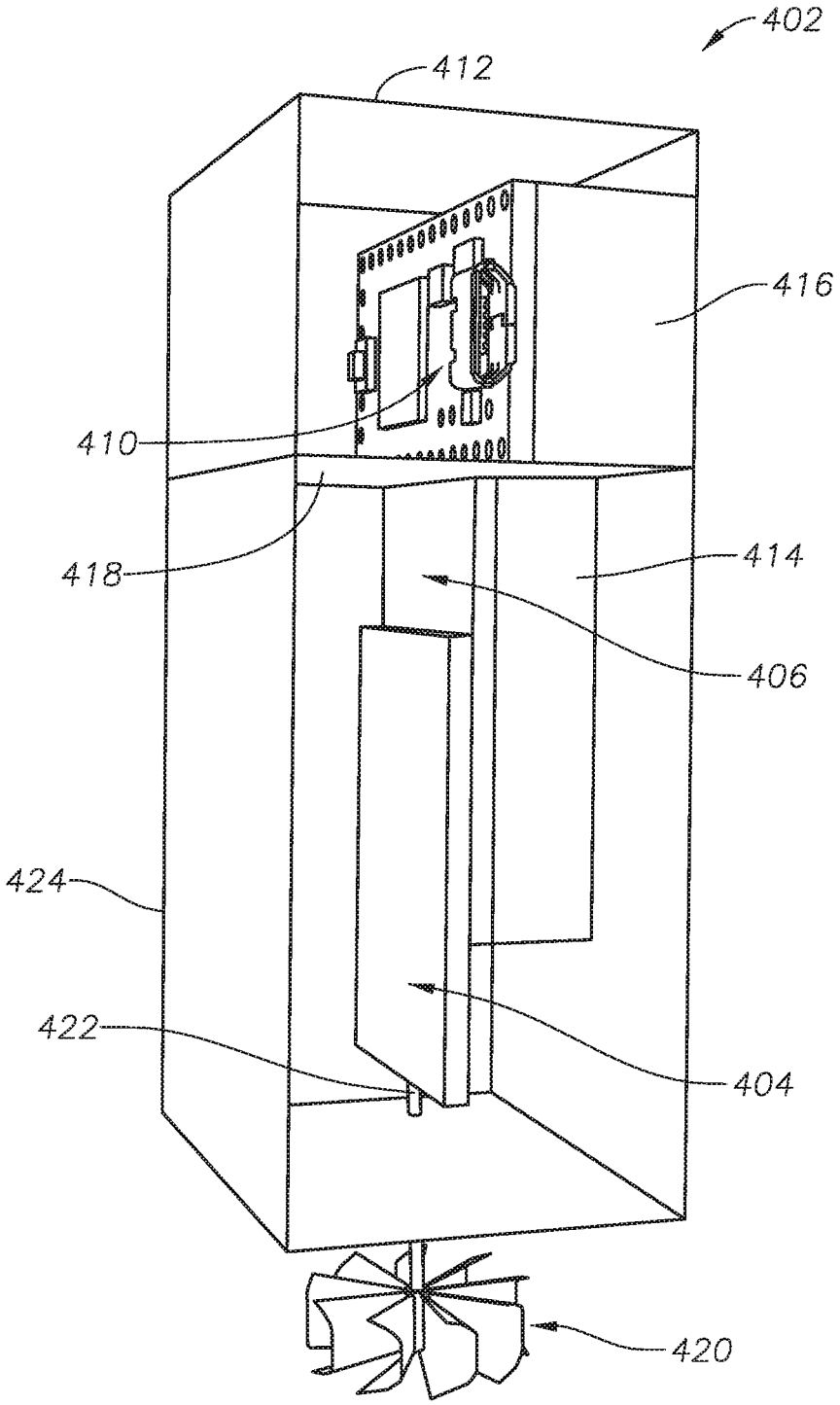
FIG. 8 is a schematic of a high temperature downhole power generating device, sensors, and transceivers, according to one or more example embodiments.
Figure 9:
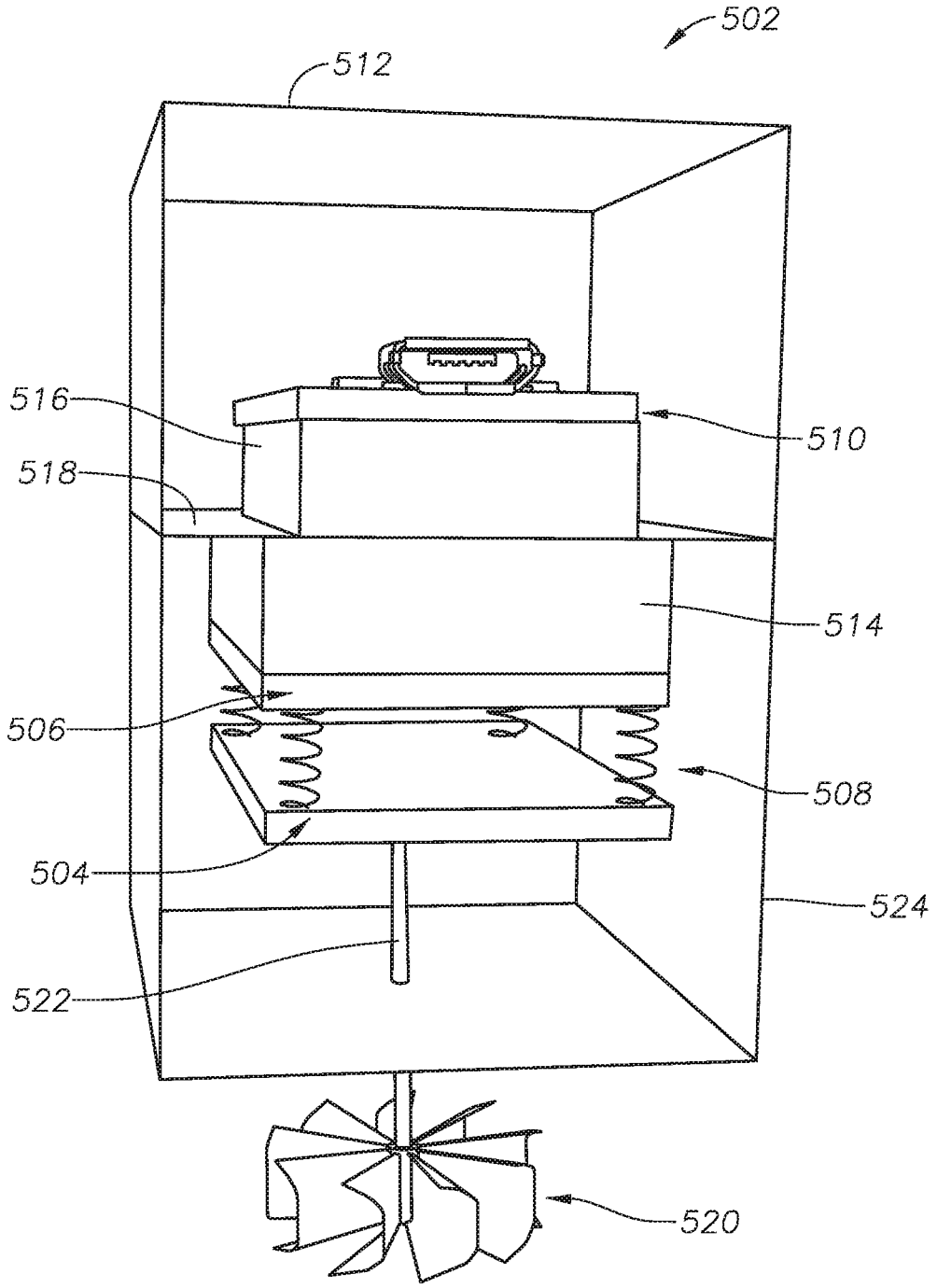
FIG. 9 is a schematic of a high temperature downhole power generating device, sensors, and transceivers, according to one or more example embodiments.
Figure 10A:
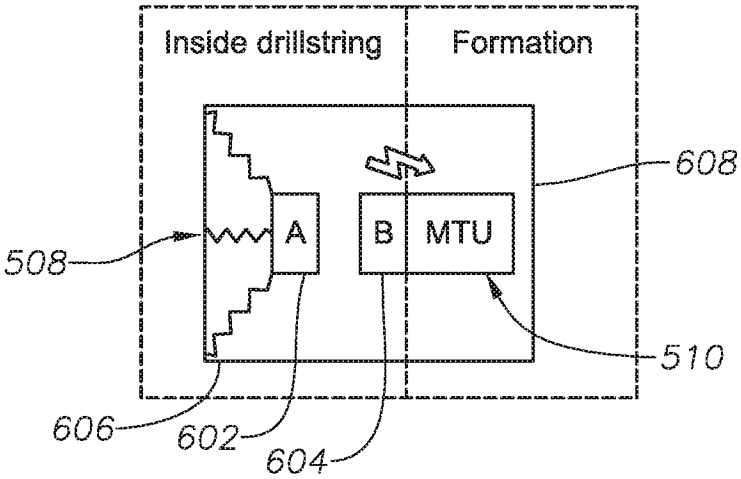
FIGS. 10(*a*) and (*b*) illustrate schematics of a spring-based high temperature downhole power generator, and FIGS. 10(*c*) and (*d*) illustrate schematics of a turbine/fan-based high temperature downhole power generator, where the power generators, the microcontrollers and transceiver units are as illustrated in FIG. 4.
Figure 10B:
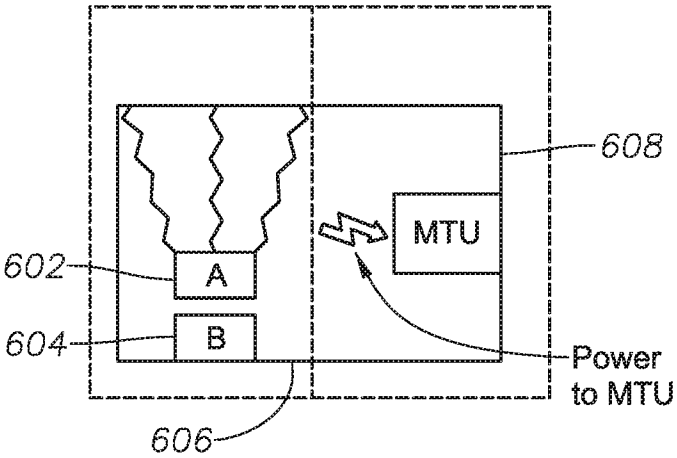
Figure 10C:
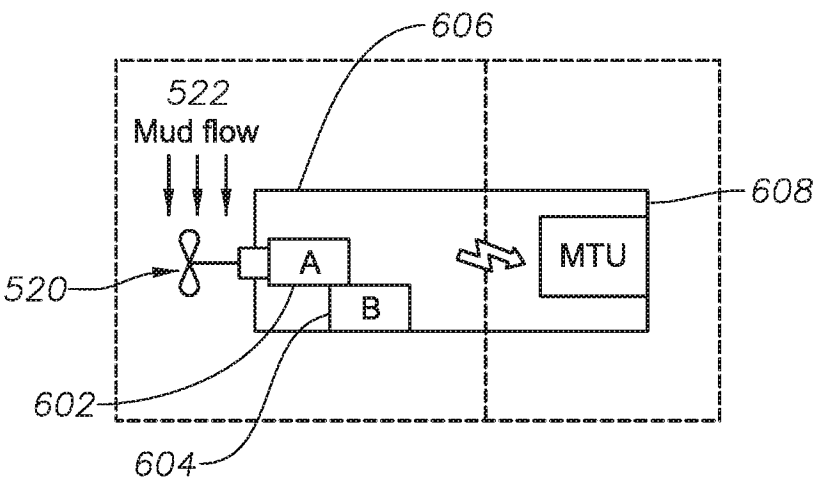
Figure 10D:
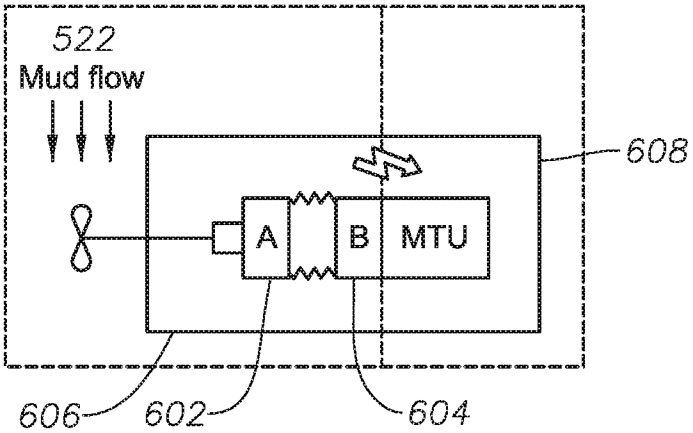
Figure 11A:
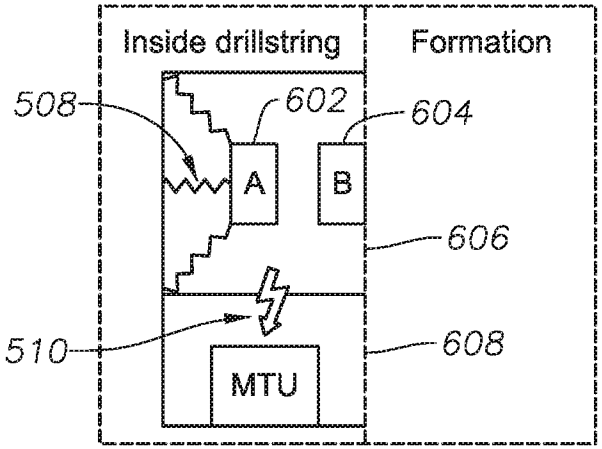
FIGS. 11(*a*) and (*b*) illustrate schematics of the spring-based high temperature downhole power generator, and FIGS. 11(*c*) and (*d*) illustrate schematics of a turbine/fan based high temperature downhole power generator, where the power generators, the microcontrollers and transceiver units are as illustrated in FIG. 5.
Figure 11B:
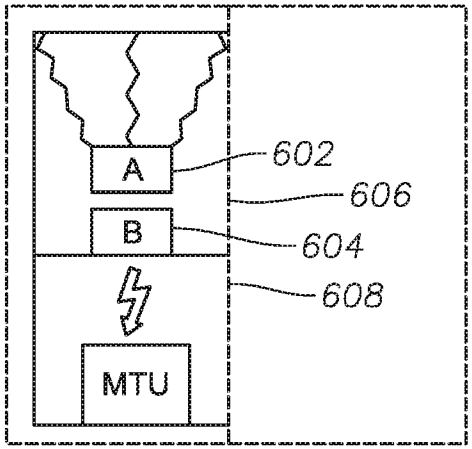
Figure 11C:
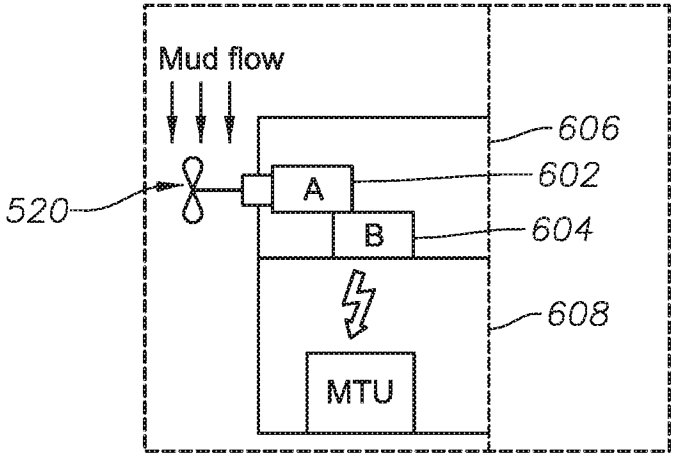
Figure 11D:
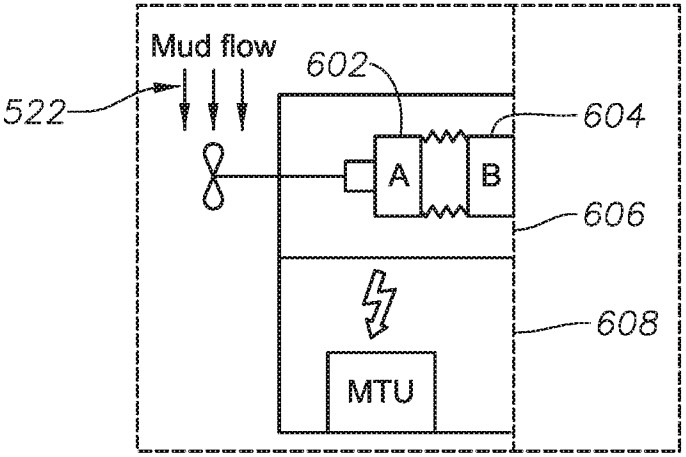

Another example embodiment, illustrated in FIGS. 8 and 9, employs a mini-turbine or fan 420, 520 to capture the energy from mudflow and create friction between two materials, of opposite polarity, to generate electricity. The mini-turbine 420, 520 can be designed as a hydro turbine, pelton runner, etc. and is small enough to be integrated with the power generator and the MTU. The blades of the mini-turbine/fan 420, 520 are connected to the center shaft 422, 522. The kinetic energy of the mud flow in a drill string 120 rotates the blades of the mini-turbine/fan 420, 520. The mini-turbine or fan 420, 520 is connected to a shaft 422, 522 and the shaft 422, 522 is connected to material 404, 504. The shaft 422, 522 is used to generate linear motion or can be used with a crank/slider-crank, a dwell cam system or mechanical gears for example to push or slide material 404, 504 onto material 406, 506, which is opposite in polarity to material 404, 504 and is fixed and stationary, as shown in FIG. 8. The mini-turbine/fan 520 can also be used to push material 504 onto material 506, as shown in FIG. 9. Both these motions ensure the contact and separation of the materials to generate electricity. In mini-turbine/fan 420, 520 based systems the flow speed have to be optimized for maximum energy efficiency of the power generator.

The choice of materials depends on several factors. The most important is that the materials must be able to withstand high temperatures (>125° C.). Even though the MTU will be housed to minimize the effect of high temperature and pressure, it is important that the building blocks of the power generator has the ability to withstand high temperatures. This is because housing can only protect the components inside only up to a certain duration of time by conducting heat away from them according to its thermal coefficient of conduction. High durability is also an important consideration due to the repeated contact and release as well as sliding motions experienced by the materials. Materials must have good stability with little or no degradation in material properties after many cycles and they should not get damaged due to shock and vibrations. Some suitable materials are Copper, Aluminum, PTFE, Teflon, Kapton, Lead, Elastomer PDMA or any material that can cause static electricity, or any material with similar or better thermal, mechanical and chemical properties for downhole environments, which can also be deposited as thin films. Also, the materials should be relatively cheap if they are to be used in power generators to generate electricity for many transceivers. When choosing materials it is important to remember that they have opposite polarities or polarities as distant as possible from each other. Suitable materials for housing were described before. The choice of materials for the mini-turbine, fan and for the contact and sliding materials are the same as mentioned above.

FIGS. 10(*a*)-(*d*) illustrate schematics of the high temperature downhole power generating device 232 and the MTU 222, 224 illustrated in FIG. 4. The first system as illustrated in FIGS. 10(*a*) and (*b*), for example, utilizes springs 508 to propel a material 602 (material A) attached to the springs 508 towards another different material 604 (material B), which is opposite in polarity to material A and is fixed, when there is vibration due to rotation and/or mud flow and/or noise. As illustrated herein, the power can be generated by maximizing the contact between material A and B, which are of opposite polarities, during lateral vibrations as shown in FIG. 10 (*a*) or axial vibrations as shown in FIG. 10(*b*). The springs 508, that may be used can be compression, extension, torsion, Belville springs or any other system made from elastic materials.

A mini-turbine/fan 520 can also be integrated to slide material A over material B as shown in FIG. 10(*c*) or contact vertically as shown in FIG. 10(*d*). The choice of materials depends on several factors. The most important is that the materials must be able to withstand high temperatures (>125° C.). Even though the MTU will be housed to minimize the effect of high temperature and pressure, it is important that the building blocks of the power generator has the ability to withstand high temperatures. This is because housing can only protect the components inside only up to a certain duration of time by conducting heat away from them according to its thermal coefficient of conduction. High durability is also an important consideration due to the repeated contact and release as well as sliding motions experienced by the materials. Materials must have good stability with little or no degradation in material properties after many cycles and they should not get damaged due to shock and vibrations. According to one example embodiment, material A and material B may be selected from the group consisting of Copper, Aluminum, Polytetrafluoroethylene (PTFE), Polyimide, Lead, Elastomer, Polydimethylacrylamide (PDMA), Nylon, Teflon, Kapton, Polyester, fire-resistant materials, or any material that can cause static electricity, or any material with similar or better thermal, mechanical and chemical properties for downhole environments, which can also be deposited as thin films. Also, the materials should be relatively cheap if they are to be used in power generators to generate electricity for many transceivers. When choosing materials it is important to remember that they have opposite polarities or polarities as distant as possible from each other. The choice of materials for the mini-turbine, fan and for the contact and sliding materials are the same as mentioned above.

The electrical connection between the power generator 606 and the MTU 510 can be made by vias in the drill string. The main advantage of having the power generator inside the drill string is that it can utilize the energy from mud flow even if there is total lost circulation in the wellbore. The housing of the MTU 608 is different to the housing of the power generator 606. In order to minimize vibrations in the MTU 510, mounts and valves can be installed to isolate vibrations, and materials such as Steel, Titanium, Silicon Carbide, Aluminum Silicon Carbide Inconel and Pyroflask, can be used to reduce the effect of high temperature. The housing can be placed on a drill pipe similar to how multilayer composite centralizers or wear bands are placed on a drill pipe. Therefore, there is no restriction on the location to place them such as limiting them to be between connections of drill pipes. The material for the housing of the power generator on the other hand should be designed to preserve its flexibility and elasticity to maximize vibrations and hence, improve the energy conversion efficiency. However, it but must be optimized so that the building blocks of the power generator will not be damaged. Therefore, for optimization we use specific materials for the building blocks of the power generator as described below. The housing can be designed from a polymer material such as elastomer, which is already used in downhole tools, or any other material that has excellent heat conduction properties and a low Young's modulus. Packaging and housing is mainly done to protect the power generator from mud and other fluids in the formation, which may degrade its performance. However, it is important that the packaging and housing does not in any way influence the energies being harvested by reducing the vibration for example. The housing and packaging should maintain or amplify the energies being harvested.

FIGS. 11(*a*)-(*d*) illustrate schematics of the high temperature downhole power generating device 220 illustrated in FIG. 5. The arrangement of the spring-based power generator 606 and the MTU 510 for the inner-band design are showed in FIGS. 11(*a*) and (*b*), for example, where the power generator 606 and the MTU 510 are both provided inside the drill string 120. In one example embodiment, as illustrated in FIGS. 11(*c*) and 11(*d*), a turbine 520 may be provided to take advantage of the mud flow 522, for example.

The example embodiments disclosed provide downhole power generation sufficient to supply required power source to power each data relay device along the drillstring to achieve a much higher data transmission rate, that is also not affected by in-situ mud types. It is therefore designed to be a self-powered telemetry system, particularly suitable for extra high temperature (>125° C.) environments.

Example embodiments relate to a high temperature, self-powered, downhole communications system (HTSP-DCS) to increase the speed and enhance the reliability of data transmission between the bottom of the drill string and the surface in high temperature wellbores. Increasing the speed of data transmission allows the accurate characterization of the formation being drilled and the downhole environment so that the target reservoir can be reached according to plan. Moreover, the smart drill pipe concept, where real time distributed sensing data can be obtained from the surface to the bottom of hole, enables the real-time detection of kicks in deep reservoirs with partial/severe loss zones leading to precise control of the well.

The downhole power generator described in the above example embodiments is designed to generate electricity by using friction between two materials of opposite polarities. With the aid of unique apparatuses we describe how to fully exploit the mechanical/hydraulic energies usually encountered in a drilling environment, such as vibration and mud flow, to generate friction between two materials. However, the design of such a generator must be carefully designed and optimized when utilized in a well to fully exploit the available downhole energy sources without causing interference with exploration and production activities. Vibration can be triggered directly by mechanical motion and mud flow and in-directly with the aid of mud flow and a mini-turbine. Generating electricity by friction is based on the principle that an object becomes electrically charged after it contacts another material through friction. When they contact, charges move from one material to the other. Some materials have a tendency to gain electrons and some to lose electrons. If material A has a higher polarity than material B, then electrons are injected from material B into material A. This results in oppositely charged surfaces. When these two materials are separated there is current flow, when a load is connected between the materials, due to the imbalance in charges between the two materials. The current flow continues until both the materials are at the same potential. When the materials move towards each other again there is a current flow again, but in the opposite direction. Therefore, this contact and separation motion of materials can be used to generate electricity. Moreover, the materials used to build the power source such as Aluminum, Copper, Kapton, PTFE PDMS or any material that can cause static electricity work at high temperatures (>125° C.).

Systems described in the above example embodiments include wireless communication technology as a data transmission method. Data transmission data rates up to a million times faster than mud pulse telemetry (bits per second to megabits per second) can be achieved by coupling wireless communication technology with transceivers placed at specific locations in the drill string to transmit data from the MWD and LWD tools to the surface. Increased data transmission rates provides significant advantages in a drilling environment such as the opportunity to immediately respond to well control problems and revise mud programs. The mud pulse telemetry system is replaced by an array of transceivers placed at specific locations on the drill pipe, from the bottom of the well to the surface. Each transceiver is connected to the power generator mentioned above and is triggered by mechanical/hydraulic motions in a downhole drilling environment. The distance between these transceivers are dependent on the wireless communication technologies used, the power provided by the power generator, the downhole environment and the power management circuit of the microcontroller amongst other variables. This transceiver array transmits data, from one transceiver to another as in a relay, from the bottom to the surface of the well.

Due to the increased speed of wireless communication compared to mud pulse telemetry more data can be sent per second increasing the resolution of the data obtained at the surface.

Sensors can be integrated with the communication module described in the above example embodiments. This is achievable since the sensors and the transmitters do not operate simultaneously. Once a tool stops it operation it can shut down and go to sleep to reduce power usage. The instructions to do so are handled by the microcontroller unit. The smart drill pipe gives real time distributed sensing data, which can be used to effectively monitor the well and respond immediately if there is a problem. The number and type of sensors in a communication module depend on the availability of power at each communication module.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art.

Example embodiments described in the above sections describe downhole power generation systems sufficient to supply required power for downhole sensors and instrumentation. The system is not affected by in-situ mud types. It is therefore designed to be a self-powered power generator, particularly suitable for utilization in high temperature (>125° C.) environments. Accordingly, one example embodiment is a high temperature downhole power generator that generates electricity. The HT-DPG uses mechanical and hydraulic energies in a typical well to generate friction between two materials of opposite polarities and creates power to power the downhole sensors to monitor and track information concerning the well. The materials may be made of Copper, Aluminum, PTFE, Teflon, Kapton, Lead, Elastomer PDMA or any material that can cause static electricity. The shapes of the materials, which may be in the form of blocks, can be rectangular, triangular, circular or any shape that maximizes the contact area depending on the design of the system. The system may also include a microcontroller and transceiver unit (MTU) that manages the power generated and controls the communication of information from the microcontroller to other transceivers. The information is stored on memory on board of the microcontroller and information can be sent through wireless technologies through various transceivers throughout the well.

Another example embodiment is a high temperature, downhole power generator designed to generate electricity by using friction between two materials of opposite polarities or polarities as distant as possible from each other. Movement in a drilling environment, such as vibration and mud flow, may generate friction between two materials. One example embodiment provides for how the high temperature downhole power generator provides power to downhole sensors and instrumentation (S&I) and how the integration of high temperature downhole power generator and S&I paves the way for self-powered downhole communication systems.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. A system for wirelessly monitoring well conditions, the system comprising:

an array of wireless transceivers placed along a drill string inside a well, each transceiver placed within at least half the maximum distance that each transceiver can transmit data;

a power generator attached to each transceiver that powers the respective transceiver, wherein the wireless transceivers communicate over a wireless communication method selected from the group consisting of Wi-Fi, Wi-Fi Direct, Bluetooth, Bluetooth Low Energy, and ZigBee;

a first housing for housing the power generator and a bridge rectifier; and a second housing for housing a storage unit, a microcontroller, and a transceiver unit, wherein the second housing comprises a hollow housing structure that provides clearance for the drilling fluids to flow through.

2. The system according to claim 1, further comprising:

at least one sensor that gathers information concerning a downhole environment connected to one of the wireless transceivers; and a microcontroller unit connected to each of the wireless transceivers to manage the power generated by the power generator.

3. The system according to claim 2, wherein the wireless transceiver is configured to transmit information to a first transceiver placed within at least half the maximum distance that each transceiver can transmit data.

4. The system according to claim 2, wherein the wireless transceiver is configured to transmit information to second transceiver placed at the maximum distance that each transceiver can transmit data.

5. The system according to claim 1, wherein the at least one sensor comprises a MWD or LWD sensor.

6. The system according to claim 1, wherein the power generator is embedded inside the drill string and the wireless transceiver is embedded outside the drill string.

7. The system according to claim 1, wherein the power generator and the wireless transceiver are embedded inside the drill string.

8. The system according to claim 1, wherein the first housing comprises a polymeric material.

9. The system according to claim 1, wherein the second housing comprises a material selected from the group consisting of certain solids, transition metals, as well as high strength alloys and/or compounds of the transition metals, and high temperature dewars.

10. The system according to claim 1, wherein the storage unit comprises at least one of dielectric capacitors, ceramic film capacitors, electrolytic capacitors, supercapacitors, double-layer capacitors, and pseudo-capacitors.

11. The system according to claim 1, wherein at least one of the wireless transceivers comprises a sleep mode, a standby mode, and an active mode of operation.

12. The system according to claim 1, wherein the power generator further comprises:

a first material that is of one polarity and a second material that is fixed in position relative to the first material and is of opposite polarity of the first material; and wherein the first material is propelled towards the second material based on the motion of the power generator so that the two materials have a maximized point of contact to generate maximum power.

13. The system according to claim 12, further comprising:

nano particles deposited on the first material or the second material to form nano pillars or nano patterns.

14. The system according to claim 12, wherein the first material is selected from the group consisting of Copper, Aluminum, Polytetrafluoroethylene (PTFE), Polyimide, Lead, Elastomer, Polydimethylacrylamide (PDMA), Nylon, and Polyester.

15. The system according to claim 12, wherein the second material is selected from the group consisting of Copper, Aluminum, Polytetrafluoroethylene (PTFE), Polyimide, Lead, Elastomer, Polydimethylacrylamide (PDMA), Nylon, and Polyester.

16. The system according to claim 12, wherein the first material is suspended using one or more coil springs.

17. The system according to claim 12, further comprising:

a turbine connected to the first material for causing the first material to move towards the second material or away from the second material.

18. The system according to claim 12, wherein the power generator further comprises:

at least one electrode that is connected to the first material or second material, wherein the bridge rectifier is connected to the at least one electrode to transform the power generated into direct current from alternating current; and the storage unit is configured to store the power generated by the power generator.

* * * * *